US007615521B2

(12) United States Patent
Eveland et al.

(10) Patent No.: US 7,615,521 B2
(45) Date of Patent: Nov. 10, 2009

(54) MIXED DISPERSANTS FOR LUBRICANTS

(75) Inventors: Renee A. Eveland, Concord Township, Lake County, OH (US); Frederick W. Koch, Willoughby Hills, OH (US); Robert Ian Wilby, Chesterfield (GB); Virginia A. Carrick, Chardon, OH (US); William D. Abraham, Concord Township, Lake County, OH (US); Gordon D. Lamb, Southend Bradfield (GB); John K. Pudelski, Cleveland Heights, OH (US)

(73) Assignee: The Lubrizol Corporation, Wickliffe, OH (US)

( * ) Notice: Subject to any disclaimer, the term of this patent is extended or adjusted under 35 U.S.C. 154(b) by 833 days.

(21) Appl. No.: 10/898,804

(22) Filed: Jul. 26, 2004

(65) Prior Publication Data

US 2005/0202981 A1 Sep. 15, 2005

Related U.S. Application Data

(60) Provisional application No. 60/492,153, filed on Aug. 1, 2003.

(51) Int. Cl.
*C10M 133/56* (2006.01)
*C07C 309/62* (2006.01)

(52) U.S. Cl. ..... 508/228; 508/390

(58) Field of Classification Search ..... 508/185, 508/228, 390

See application file for complete search history.

(56) References Cited

U.S. PATENT DOCUMENTS

| | | | | | |
|---|---|---|---|---|---|
| 3,381,022 | A | | 4/1968 | LeSuer | |
| 3,912,764 | A | | 10/1975 | Palmer | |
| 4,110,349 | A | | 8/1978 | Cohen | |
| 4,162,985 | A | * | 7/1979 | Holubec | 508/338 |
| 4,234,435 | A | * | 11/1980 | Meinhardt et al. | 508/192 |
| 4,489,194 | A | | 12/1984 | Hayashi | |
| 4,582,618 | A | * | 4/1986 | Davis | 508/338 |
| 5,041,622 | A | | 8/1991 | LeSuer | |
| 5,266,223 | A | | 11/1993 | Song et al. | |
| 5,356,552 | A | | 10/1994 | Harrison et al. | |
| 5,422,024 | A | | 6/1995 | Vickerman et al. | |
| 5,454,964 | A | * | 10/1995 | Blackborow et al. | 508/496 |
| 5,540,851 | A | | 7/1996 | Lange | |
| 5,625,004 | A | | 4/1997 | Harrison et al. | |
| 5,674,819 | A | * | 10/1997 | Sivik et al. | 508/234 |
| 5,719,108 | A | | 2/1998 | Wilby et al. | |
| 5,792,730 | A | | 8/1998 | Gutierrez et al. | |
| 6,030,929 | A | | 2/2000 | Pudelski | |
| 6,077,909 | A | | 6/2000 | Pudelski et al. | |
| 6,140,279 | A | | 10/2000 | MacDonald et al. | |
| 6,165,235 | A | | 12/2000 | Kolp et al. | |
| 2003/0013620 | A1 | | 1/2003 | Wilk | |
| 2003/0073587 | A1 | | 4/2003 | Harrison et al. | |

FOREIGN PATENT DOCUMENTS

| | | |
|---|---|---|
| EP | 0 355 895 | 2/1990 |
| EP | 0 475 609 | 3/1992 |

* cited by examiner

*Primary Examiner*—Cephia D Toomer
(74) *Attorney, Agent, or Firm*—David M. Shold; Christopher D. Hilker

(57) ABSTRACT

A dispersant composition comprising the product of an amine, an alcohol, or an amino alcohol, with a hydrocarbyl-substituted succinic anhydride component exhibits improved viscosity stability and reduced chlorine content, when the hydrocarbyl-substituted succinic anhydride component comprises: (a) 10 to 95 weight percent of a component prepared by reacting a polyisobutylene with maleic anhydride in the presence of chlorine; and (b) 5 to 90 weight percent of a component prepared by reacting a polyisobutylene with maleic anhydride in the substantial absence of chlorine.

28 Claims, No Drawings

MIXED DISPERSANTS FOR LUBRICANTS

CROSS-REFERENCE TO RELATED APPLICATIONS

This application claims priority from U.S. provisional application Ser. No. 60/492,153, filed Aug. 1, 2003.

BACKGROUND OF THE INVENTION

The present invention relates to improved dispersant suitable for use as lubricant additives.

Succinimide dispersants of various types are known, including those based on polymer-substituted acylating agents (e.g., succinic anhydrides) prepared by a chlorine-containing alkylation route and those prepared by a so-called "thermal" or non-chlorine alkylation route. Many such dispersants, especially those from the chlorine route have the unwanted effect of leading to an increase in viscosity of lubricant formulations or especially concentrates in which they are included, particularly after the formulation has been allowed to stand for several days to weeks at elevated temperatures. It has now been found that dispersants prepared from a mixture of the chlorine route and the thermal route acylating agents exhibit a significantly reduced level of viscosity increase, compared to those prepared by the chlorine route alone, even when only a relatively small amount of material from the thermal route is present. Such mixtures have the additional benefit of contributing a reduced amount of chlorine to the lubricant to which they are added. Yet another benefit is that the concentrate viscosity of such mixtures of dispersants is lower than that of concentrates of the dispersant from the Cl process alone, leading to improved ease in handling. This improvement is especially significant in concentrate formulations which contain an overbased calcium sulfonate detergent.

Moreover, the present combinations of dispersants can provide a proper balance of seal compatibility, corrosion protection, and antiwear performance required in modern low phosphorus-low sulfur lubricants for heavy duty diesel engines. The proposed reduction of sulfur and phosphorus levels in future diesel oil formulations will necessitate the reduction of the amount of zinc dialkyldithiophosphate ("ZDP") in the formulation. The reduction of ZDP will be expected to lead to severely reduced antiwear protection of the oil. By using a combination of the dispersants from the chlorine route and the thermal route, as described herein, formulations can be prepared which pass seal compatibility testing (as measured by the MB Viton™ Seal Test), corrosion testing (as measured by the HTCBT test), as well as a wear screening test.

U.S. Pat. No. 5,041,622, LeSuer, Aug. 20, 1991, discloses a process for preparing substituted carboxylic acids useful as acylating agents, reacting an olefin with an acidic reagent such as maleic acid, in the presence of chlorine.

U.S. Pat. No. 6,165,235, Kolp et al., Dec. 26, 2000, U.S. Pat. No. 6,077,909, Pudelski et al., Jun. 20, 2000, disclose acylating agents which are reacted with amines or alcohols to form dispersants having reduced chlorine content.

U.S. Pat. No. 5,719,108, Wilby et al., Feb. 16, 1998, discloses dispersant/VI improvers for lubricating oil composition, comprising the reaction product of a copolymer of octadecene and maleic anhydride with a succinimide prepared from a polyamine and an acyclic hydrocarbyl-substituted succinic anhydride.

SUMMARY OF THE INVENTION

The present invention thus provides a dispersant composition comprising the product of (1) at least one amine having at least one N—H group, an alcohol, or an aminoalcohol with (2) a hydrocarbyl-substituted succinic anhydride component or the reactive equivalent thereof, wherein the hydrocarbyl-substituted succinic anhydride component comprises:

(a) 20 to 95 weight percent of a component wherein at least one succinic anhydride moiety is attached to the hydrocarbyl substituent through a cyclic linkage; and (b) 5 to 80 weight percent of a component wherein at least one succinic anhydride moiety is attached to the hydrocarbyl substituent through a non-cyclic linkage.

Alternatively expressed, the invention provides a dispersant composition comprising the product of (1) at least one amine having at least one N—H group, an alcohol, or an amino alcohol with (2) a hydrocarbyl-substituted succinic anhydride or the reactive equivalent thereof, wherein the hydrocarbyl-substituted succinic anhydride component comprises:

(a) 20 to 95 weight percent of a component prepared by reacting a polyisobutylene, less than about 20 percent of the chains thereof containing a terminal vinylidene end group, with maleic anhydride in the presence of chlorine; and (b) 5 to 80 weight percent of a component prepared by reacting a polyisobutylene, at least about 70 percent of the chains thereof containing a terminal vinylidene end group, with maleic anhydride in the substantial absence of chlorine.

The invention further provides a composition comprising a mixture of a hydrocarbyl-substituted succinic anhydrides or the reactive equivalent thereof, comprising:

(a) 20 to 95 weight percent of a component wherein at least one succinic anhydride moiety is attached to the hydrocarbyl substituent through a cyclic linkage; and (b) 5 to 80 weight percent of a component wherein at least one succinic anhydride moiety is attached to the hydrocarbyl substituent through a non-cyclic linkage;

or, alternatively expressed, (a) 20 to 95 weight percent of a component prepared by reacting a polyisobutylene, less than about 20 percent of the chains thereof containing a terminal vinylidene end group, with maleic anhydride in the presence of chlorine; and (b) 5 to 80 weight percent of a component prepared by reacting a polyisobutylene, at least about 70 percent of the chains thereof containing a terminal vinylidene end group, with maleic anhydride in the substantial absence of chlorine.

The invention further provides a mixture of dispersants, comprising:

(a) 20 to 95 weight percent of a dispersant prepared by reacting a polyisobutylene, less than about 20 percent of the chains thereof containing a terminal vinylidene end group, with maleic anhydride in the presence of chlorine, and reacting the intermediate formed thereby with at least one amine having at least one N—H group, an alcohol, or an aminoalcohol; and (b) 5 to 80 weight percent of a dispersant prepared by reacting a polyisobutylene, at least about 70 percent of the chains thereof containing a terminal vinylidene end group, with maleic anhydride in the substantial absence of chlorine, and reacting the intermediate formed thereby with at least one amine having at least on N—H group, an alcohol, or an aminoalcohol.

The invention further provides concentrates and fully formulated lubricants containing the foregoing materials, and a method for lubricating an internal combustion engine, by supply such lubricants thereto.

DETAILED DESCRIPTION OF THE INVENTION

Various preferred features and embodiments will be described below by way of non-limiting illustration.

There are two commonly employed processes for making succinimide dispersants. These differ in the method by which a polyalkylene (typically polyisobutylene, but also copolymers including ethylene copolymer) substituent is prepared and by which it is affixed to a mono- or diacid or anhydride moiety, especially a succinic anhydride moiety or its reactive equivalent. In a conventional process (a), isobutylene is polymerized in the presence of $AlCl_3$ to produce a mixture of polymers comprising predominantly trisubstituted olefin (III) and tetrasubstituted olefin (IV) end groups, with only a very small amount (for instance, less than 20 percent) of chains containing a terminal vinylidene group (I). In an alternative, "chlorine-free" or "thermal" process (b), isobutylene is polymerized in the presence of $BF_3$ catalyst to produce a mixture of polymers comprising predominantly (for instance, at least 70 percent) terminal vinylidene groups, with smaller amounts of tetrasubstituted end groups and other structures. These materials, sometimes referred to as "high vinylidene PIB," are also described in U.S. Pat. No. 6,165,235, Table 1 of which is reproduced below:

TABLE 1

| PIB Terminal Groups | (a) Typical Percent in Conventional PIB | (b) Typical Percent in High Vinylidene PIB |
|---|---|---|
| 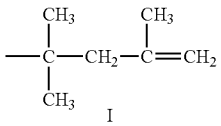 I | 4–5% | 50–90% |
| 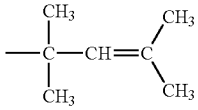 II | 0–2% | 6–35% |
| 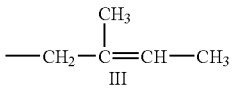 III | 63–67% tri-substituted | absent or minor |
| 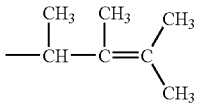 IV | 22–28% tetrasubstituted | 1–15% |
| 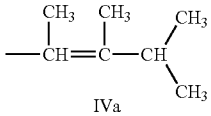 IVa | IV and IVA | |

TABLE 1-continued

| PIB Terminal Groups | (a) Typical Percent in Conventional PIB | (b) Typical Percent in High Vinylidene PIB |
|---|---|---|
| 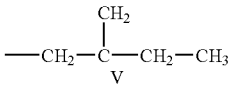 V | 5–8% | 0–4% |
| OTHER | 0–10% | |

The conventional polyisobutylene of (a) reacts with maleic anhydride in the presence of a catalytic amount of chlorine by a series of chlorination, dehydrochlorination, and Diels-Alder reactions, more fully described in U.S. Pat. No. 6,165,235, to provide a significant amount of di-succinated polymeric material which is believed to have predominantly the general structure (VI):

VI

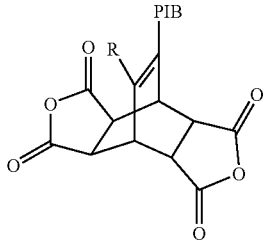

where R is —H or —$CH_3$ and PIB represents a polyisobutene residue after reaction. A certain amount of mono-reacted cyclic material can also be present, as shown:

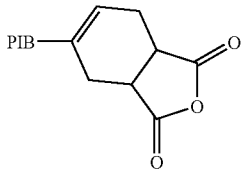

and, in one instance, the hydrocarbyl-substituted succinic anhydride of (a) contains on average 1.1 or 1.3 to 1.8 succinic anhydride moieties per hydrocarbyl group. It is also believed that a minor amount (e.g., up to 7 or 15 or 18 percent, e.g., 7 to 15 percent) of the product may contain a succinic anhydride moiety attached to the hydrocarbyl group by one sort or another of non-cyclic linkage.

In contrast, high vinylidene polyisobutylene of (b) is believed to react with maleic anhydride in the absence of chlorine by a series of thermal "ene" reactions to produce a mixture of mono- and di-succininated polymeric material, the latter believed to have predominantly the general structure (VII):

VII

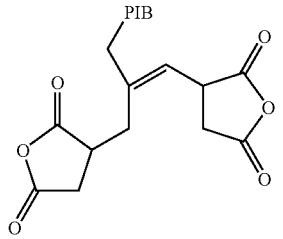

(non-cyclic disuccinated polymeric material)

the double bond being located at either position about the central carbon atom. Preparation of acylating agents from polyisobutylene made from a $BF_3$ process and their reaction with amines is disclosed in U.S. Pat. No. 4,152,499. Similar adducts can be made using polymers other than polyisobutylene; for instance U.S. Pat. No. 5,275,747 discloses derivatized ethylene alpha-olefin polymers with terminal ethenylidene unsaturation which can be substituted with mono-or dicarboxylic acid producing moieties. These materials of component (b) may also contain a small amount of materials with cyclic structure. The cyclic components, however, are predominantly provided by materials from the chlorine route (process (a)) and the non-cyclic components are predominantly provided by materials from the thermal route (process (b)).

The two types of products, described above and also referred to as (a) and (b), are described in this text both in terms of their structure and in terms of their method of manufacture (chlorine versus non-chlorine or thermal process) for the purpose of completeness and clarity in description, and because it to be understood that further investigation may show that the structures depicted may prove to be incomplete or even to some extent incorrect. Nevertheless it is important to recognize that the materials prepared by the chlorine process are different from those prepared by the non-chlorine route, and these differences, whatever they may ultimately prove to be, lead to the performance characteristics of the present invention. For example, it is also believed that the product from the chlorine reaction typically contains a certain percentage of internal succinic functionality, that is, along the backbone of the polymer chain, while such internal succinic functionality is believed to be substantially absent from the non-chlorine material. This difference may also play a role in the performance of the present invention. Applicants do not intend to be bound by any such theoretical explanation.

The hydrocarbyl substituents on each of the succinic anhydride components should normally be of sufficient length to provide a desired degree of solubility in a lubricating oil. Thus, while the length of the hydrocarbyl substituent in component (a) need not be the same as in component (b), each of (a) and (b) will typically have a molecular weight of at least 300, at least 800, or at least 1200, e.g., that of component (a) can be at least 1200. Typical upper limits to the molecular weight may be determined by considerations of solubility, cost, or other practical considerations, and may be up to 5000 or up to 2500. Thus, for instance, the hydrocarbyl substituents of components (a) and (b) can independently have a molecular weight of 300 to 5000 or 800 to 2500.

Each of the two types of succinated polymeric materials can further react with an amine, an alcohol, or a hydroxyamine, and preferably a polyamine, to form a dispersant. Dispersants of this type generally are well known and are disclosed, for instance, in U.S. Pat. No. 4,234,435 (especially for type (a)) and in U.S. Pat. No. 5,719,108 (especially for type (b)).

Amines which can be used in preparing dispersants include polyamines, such as aliphatic, cycloaliphatic, heterocyclic or aromatic polyamines. Examples of the polyamines include alkylene polyamines, hydroxy containing polyamines, arylpolyamines, and heterocyclic polyamines.

Alkylene polyamines are represented by the formula

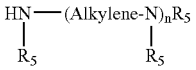

wherein n typically has an average value 1, or 2 to 10, or to 7, or to 5, and the "Alkylene" group has 1, or 2 to 10, or to 6, or to 4 carbon atoms. Each $R_5$ is independently hydrogen, or an aliphatic or hydroxy-substituted aliphatic group of up to 30 carbon atoms. Examples of such alkylenepolyamines include ethylenepolyamines, butylenepolyamines, propylenepolyamines, and pentylenepolyamines. The higher homologs and related heterocyclic amines such as piperazines and N-aminoalkyl-substituted piperazines are also included. Specific examples of such polyamines are ethylenediamine, diethylenetriamine (DETA), triethylenetetramine (TETA), tris-(2-aminoethyl)amine, propylenediamine, trimethylenediamine, tripropylenetetramine, tetraethylenepentamine (TEPA), hexaethyleneheptamine, and pentaethylenehexamine. Higher homologs obtained by condensing two or more of the above-noted alkylene amines are similarly useful as are mixtures of two or more of the aforedescribed polyamines. Such polyamines are described in detail under the heading Ethylene Amines in Kirk Othmer's "Encyclopedia of Chemical Technology", 2d Edition, Vol. 7, pages 22-37, Interscience Publishers, New York (1965). Other useful types of polyamine mixtures are those resulting from stripping of the above-described polyamine mixtures to leave as residue what is often termed polyamine bottoms or, more specifically, polyethyleneamine bottoms.

Another useful polyamine is a condensation reaction between a hydroxy compound and a polyamine reactant containing at least one primary or secondary amino group, as described in U.S. Pat. No. 5,053,152 and PCT publication WO86/05501.

Alternatively, the hydrocarbyl-substituted succinic anhydride component may be reacted with an alcohol, to form an ester (mono- or diester) or with a hydroxyamine, to form any of a variety of products such as esters, amides, ester-amides, imides, or mixtures thereof. Dispersants prepared by reacting such alcohols or hydroxyamines are generally known.

Although dispersants of various types are well known, the dispersants of the present invention are distinguished from those conventionally used in that they are specifically mixed dispersants, containing molecules of the above-described types (a) and (b). They can be prepared either by reacting a mixture of chlorine-route or cyclic structure-containing material type (a) and thermal-route or linear structure-containing material type (b) acylating agents with an amine, preferably a polyamine (or an alcohol, or aminoalcohol), that is, in a single reaction, or by mixing together complete dispersants separately prepared from the reaction with hydrocarbyl-substituted succinic anhydride components made via these two routes. Additionally, in the case where the acylating agents of (a) and (b) are mixed and the mixtures is reacted with a polyamine, an aminoalcohol, or a polyol, the resulting product can be distinguished in that both types of linkages (cyclic and linear) can be present in a certain portion of the molecules of the resulting dispersant.

The relative amounts of the materials designated (a) and (b) herein are such that 10 or 15 or 20 or 25 weight percent to 95 weight percent of the hydrocarbyl-substituted succinic anhydride component (whether the anhydride as such or whether further reacted to form a dispersant) is of the type (a) and 5 to 75 or to 80 or to 85 or to 90 weight percent is of the type (b). Alternative amounts include 30 to 95 or 30 to 90% (a) and 5 to 70 or 10 to 70% (b). Materials (a) and (b) will typically together total 100 percent of the succinic anhydride-based dispersant (or succinic anhydride component) present in the composition. Alternatively, the amounts indicated for (a) and (b) can be based upon the total of (a) and (b), even if a certain amount of another type of similar component may be present. In certain embodiments the relative amount of type (a) is 50 to 90 weight percent or 60 to 85 weight percent, or 30, 50, or 60 to 80 weight percent; and the relative amount of type (b) is 10 to 50 weight percent or 15 to 40 weight percent or 20 to 40, 50, or 70 weight percent. That is, a relatively minor portion of the type (b) material, the linearly linked or non-chlorine material, can be used with a relatively major portion of the type (a) material, the cyclic linked or chlorine process material, and provide an improvement (reduction) in the viscosity increase of the dispersant formulation beyond what would be expected based on a consideration of the properties of the individual components. In a fully formulated lubricant, the amount of dispersant of type (a) can be 0.5 to 10 percent by weight, preferably 1.0 to 6.0 or 1.5 to 5 percent, and the amount of dispersant of type (b) can be 0.5 to 10 percent by weight, preferably 1.0 to 9.0 or 1.5 to 6 or 2 to 5 percent.

Dispersants prepared from the thermal process, that is, the non-cyclic materials of (b) can have, in certain embodiments, a Total Acid Number (TAN) of at least 5.7 or 7.1 or 8.6, and a Total Base Number (TBN) of at most 29 or 26 or 21. These values are for the neat or diluent-free dispersant. If the TAN or TBN is measured on the oil-diluted material as commonly commercially provided, containing, e.g., 30% diluent oil, the corresponding values would be recalculated to, e.g., a TAN at least 4 or 5 or 6 and a TBN of at most 20 or 18 or 15.

As used herein, the term "hydrocarbyl substituent" or "hydrocarbyl group" is used in its ordinary sense, which is well-known to those skilled in the art. Specifically, it refers to a group having a carbon atom directly attached to the remainder of the molecule and having predominantly hydrocarbon character. Examples of hydrocarbyl groups include:

- hydrocarbon substituents, that is, aliphatic (e.g., alkyl or alkenyl), alicyclic (e.g., cycloalkyl, cycloalkenyl) substituents, and aromatic-, aliphatic-, and alicyclic-substituted aromatic substituents, as well as cyclic substituents wherein the ring is completed through another portion of the molecule (e.g., two substituents together form a ring);
- substituted hydrocarbon substituents, that is, substituents containing non-hydrocarbon groups which, in the context of this invention, do not alter the predominantly hydrocarbon nature of the substituent (e.g., halo (especially chloro and fluoro), hydroxy, alkoxy, mercapto, alkylmercapto, nitro, nitroso, and sulfoxy);
- hetero substituents, that is, substituents which, while having a predominantly hydrocarbon character, in the context of this invention, contain other than carbon in a ring or chain otherwise composed of carbon atoms. Heteroatoms include sulfur, oxygen, nitrogen, and encompass substituents as pyridyl, furyl, thienyl and imidazolyl. In general, no more than two, preferably no more than one, non-hydrocarbon substituent will be present for every ten carbon atoms in the hydrocarbyl group; typically, there will be no non-hydrocarbon substituents in the hydrocarbyl group.

The mixed hydrocarbyl-substituted succinic anhydrides or acids of the present invention, or, especially, the mixed dispersants of the present invention, can be prepared in or used in an oil of lubricating viscosity. When the dispersants are synthesized (separately or together) in an oil of lubricating viscosity, the resulting commercial products will typically contain 40 to 60 percent oil (e.g., a "concentrate-forming amount"). Such concentrates, as well as concentrates containing 30 to 80 percent oil or 45 to 55 percent oil, are normally susceptible to the above-mentioned viscosity increase upon ageing, particularly if the only dispersant is one prepared by the chlorine process. It is in such concentrates that one of the advantages of the present invention is particularly well revealed. That is, the increase in viscosity is significantly reduced when even a relatively minor proportion of the dispersant is the non-chlorine or thermal product.

When used in a fully formulated lubricant, the amount of oil of lubricating viscosity from all sources (including diluent oil present in the commercial grades of various components) will typically be 75 to 98 percent by weight, preferably 78 to 96% or 80 to 94%.

The presence of the thermal product in the mixed dispersant composition of the present invention also has the benefit of reducing the total amount of chlorine present in the composition and in the resulting fully formulated lubricant. For example, the fully formulated lubricant can contain 60 parts per million or less of chlorine contributed by or arising from the dispersant composition, or alternatively, up to 50 ppm, or 40 ppm, or 30 ppm, or 20 ppm, depending to some extent, of course, on the amount of the dispersant package that is used in the given lubricant. The mixture of dispersants itself can contain 5000 ppm chlorine or less, alternatively up to 2000 ppm or 1000 ppm or 800 ppm. (These numbers are given for the dispersants absent the conventional amount of diluent oil, typically around 50%. Thus the mixture of dispersants, including the diluent oil, could contain up to about 2500, 1000, 500, or 400 ppm Cl, respectively.) Even lesser amounts would be contributed if correspondingly larger proportions of the non-chlorine process dispersant are employed.

The base oil used in the inventive lubricating oil composition may be selected from any of the base oils in Groups I-V as specified in the American Petroleum Institute (API) Base Oil Interchangeability Guidelines. The five base oil groups are as follows:

| Base Oil Category | Sulfur (%) | | Saturates(%) | Viscosity Index |
|---|---|---|---|---|
| Group I | >0.03 | and/or | <90 | 80 to 120 |
| Group II | <0.03 | and | >90 | 80 to 120 |
| Group III | <0.03 | and | >90 | >120 |
| Group IV | All polyalphaolefins (PAOs) | | | |
| Group V | All others not included in Groups I, II, III or IV | | | |

Groups I, II and III are mineral oil base stocks. The oil of lubricating viscosity, then, can include natural or synthetic lubricating oils and mixtures thereof. Mixture of mineral oil and synthetic oils, particularly polyalphaolefin oils and polyester oils, are often used.

Natural oils include animal oils and vegetable oils (e.g. castor oil, lard oil and other vegetable acid esters) as well as mineral lubricating oils such as liquid petroleum oils and solvent-treated or acid treated mineral lubricating oils of the paraffinic, naphthenic or mixed paraffinic-naphthenic types. Hydrotreated or hydrocracked oils are included within the scope of useful oils of lubricating viscosity.

Oils of lubricating viscosity derived from coal or shale are also useful. Synthetic lubricating oils include hydrocarbon oils and halosubstituted hydrocarbon oils such as polymerized and interpolymerized olefins and mixtures thereof, alkylbenzenes, polyphenyl, (e.g., biphenyls, terphenyls, and alkylated polyphenyls), alkylated diphenyl ethers and alkylated diphenyl sulfides and their derivatives, analogs and homologues thereof.

Alkylene oxide polymers and interpolymers and derivatives thereof, and those where terminal hydroxyl groups have been modified by, for example, esterification or etherification, constitute other classes of known synthetic lubricating oils that can be used.

Another suitable class of synthetic lubricating oils that can be used comprises the esters of dicarboxylic acids and those made from $C_5$ to $C_{12}$ mono-carboxylic acids and polyols or polyol ethers.

Other synthetic lubricating oils include liquid esters of phosphorus-containing acids, polymeric tetrahydrofurans, silicon-based oils such as the polyalkyl-, polyaryl-, polyalkoxy-, or polyaryloxy-siloxane oils, and silicate oils.

Hydrotreated naphthenic oils are also known and can be used, as well as oils prepared by a Fischer-Tropsch gas-to-liquid synthetic procedure as well as other gas-to-liquid oils. In one embodiment the dispersant mixture of the present invention is useful when employed in a gas-to-liquid oil.

Unrefined, refined and rerefined oils, either natural or synthetic (as well as mixtures of two or more of any of these) of the type disclosed herein-above can used in the compositions of the present invention. Unrefined oils are those obtained directly from a natural or synthetic source without further purification treatment. Refined oils are similar to the unrefined oils except they have been further treated in one or more purification steps to improve one or more properties. Rerefined oils are obtained by processes similar to those used to obtain refined oils applied to refined oils which have been already used in service. Such rerefined oils often are additionally processed by techniques directed to removal of spent additives and oil breakdown products.

The fully formulated lubricant will typically also contain (or can exclude) any of a number of additional components, of a type which will depending to some extent on whether it is to be used as an engine lubricant (e.g., gasoline engine, diesel engine, two- or four-cycle engine), a transmission fluid (for, e.g., automatic transmission, manual transmission, continuously variable transmission), a farm tractor fluid, a hydraulic fluid, a grease component, or other lubricant. The fully formulated lubricant can be used, for instance, to lubricate an internal combustion engine, by supplying the lubricant to the engine, e.g., to the crankcase, and operating the engine. Engine lubricants typically contain, in addition to the dispersants of the present invention, one or more metal-containing detergents and/or one or more metal containing compounds of sulfur and of phosphorus, as well as other components.

Metal-containing detergents are often overbased materials. Overbased materials, otherwise referred to as overbased or superbased salts, are generally single phase, homogeneous Newtonian systems characterized by a metal content in excess of that which would be present for neutralization according to the stoichiometry of the metal and the particular acidic organic compound reacted with the metal. The overbased materials are prepared by reacting an acidic material (typically an inorganic acid or lower carboxylic acid, preferably carbon dioxide) with a mixture comprising an acidic organic compound, a reaction medium comprising at least one inert, organic solvent (mineral oil, naphtha, toluene, xylene, etc.) for said acidic organic material, a stoichiometric excess of a metal base, and a promoter such as a phenol or alcohol.

The acidic organic material will normally have a sufficient number of carbon atoms to provide a degree of solubility in oil. The amount of excess metal is commonly expressed in terms of metal ratio. The term "metal ratio" is the ratio of the total equivalents of the metal to the equivalents of the acidic organic compound. A neutral metal salt has a metal ratio of one. A salt having 4.5 times as much metal as present in a normal salt will have metal excess of 3.5 equivalents, or a ratio of 4.5. Such overbased materials are well known to those skilled in the art. Patents describing techniques for making basic salts of sulfonic acids, carboxylic acids (including salicylates), phenols, phosphonic acids, and mixtures of any two or more of these include U.S. Pat. Nos. 2,501,731; 2,616,905; 2,616,911; 2,616,925; 2,777,874; 3,256,186; 3,384,585; 3,365,396; 3,320,162; 3,318,809; 3,488,284; and 3,629,109. Overbased saligenin derivative detergents, especially magnesium saligenins, are described in U.S. Pat. No. 6,310,009. Overbased salixarate detergents, especially calcium salixarates, are described in U.S. Pat. No. 6,200,936. This invention is particularly effective when used with overbased calcium sulfonate detergents.

The amount of the detergent component in a completely formulated lubricant, if present, will typically be 0.5 to 10 percent by weight, preferably 1 to 7 percent by weight, and more preferably 1.2 to 4 percent by weight. Its concentration in a concentrate will be correspondingly increased, to, e.g., 5 to 65 weight percent.

Metal containing compounds of sulfur and of phosphorus are typically metal salts of the formula

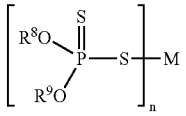

wherein $R^8$ and $R^9$ are independently hydrocarbyl groups containing 3 to 30 carbon atoms are readily obtainable by the reaction of phosphorus pentasulfide and an alcohol or phenol to form an O,O-dihydrocarbyl phosphorodithioic acid corresponding to the formula $(R^8O)(R^9O)P(=S)—SH$. A basic metal compound, preferably zinc oxide, is reacted therewith and the resulting metal compound in that preferred case is represented by the formula

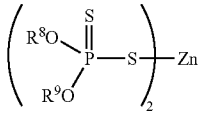

where the $R^8$ and $R^9$ groups are independently hydrocarbyl groups that are preferably free from acetylenic and usually also from ethylenic unsaturation. They are typically alkyl, cycloalkyl, aralkyl or alkaryl group and have 3 to 20 carbon atoms, preferably 3 to 16 carbon atoms and most preferably up to 13 carbon atoms, e.g., 3 to 12 carbon atoms. The alcohol which reacts to provide the $R^8$ and $R^9$ groups can be a mixture of a primary alcohol and a secondary alcohol, for instance, a mixture of 2-ethylhexanol or 4-methyl-2-pentanol with isopropanol. Such materials are often referred to as zinc dialkyldithiophosphates or simply zinc dithiophosphates. They are well known and readily available to those skilled in the art of lubricant formulation.

The amount of the metal salt of the dithiophosphorus acid in a completely formulated lubricant, if present, will typically be 0.1 to 4 percent by weight, preferably 0.5 to 2 percent by weight, and more preferably 0.75 to 1.25 percent by weight. In low-phosphorus compositions, the amount of the metal salt of phosphorus acid (e.g, ZDP) can be significantly reduced, and present in an amount of 0.05 to 2.5 percent by weight, or 0.1 to 1.5 percent, or 0.3 to 1.1 percent, or 0.5 to 0.8 percent by weight. A low-phosphorus, low-sulfur diesel oil formulation may contain 0.05% P (e.g., 0.01 to 0.1%, or 0.01 to 0.08%, or 0.02 to 0.08%, or 0.03 to 0.06% P) and 0.2% S (e.g., 0.05 to 5% or 0.1 to 0.3% S). Likewise, the amount of metal compounds in the fully formulated lubricant (from ZDP, metal detergents, and other sources) may be restricted to provide a lubricant with less than 1.2% sulfated ash (ASTM D-874), or less than 1.0 percent sulfated ash. In one embodiment, lubricants prepared from the materials of the present invention contain less than 0.5% sulfur, less than 0.11% phosphorus, and less than 1.2% sulfated ash. In another embodiment, the lubricants contain less than 0.4% or less than 0.2% sulfur, less than 0.08% or less than 0.05% phosphorus, and less than 1% or less than 0.5% sulfated ash. These limits may be varied independently of each other. Formulations containing relatively low amounts of sulfated ash, phosphorus, and sulfur are sometimes referred to as "low SAPS" formulations. The materals of the present invention can be used in either "high SAPS" or "low SAPS" formulations.

Other additives that may be present include additional dispersants such as additional succinimide dispersants, Mannich dispersants, ester-containing dispersants, and polymeric dispersants (dispersant viscosity modifiers). Any of the dispersants, including the dispersants of the present invention, can also be post-treated by reaction with any of a variety of agents. Among these are urea, thiourea, dimercaptothiadiazoles, carbon disulfide, aldehydes, ketones, carboxylic acids, hydrocarbon-substituted succinic anhydrides, nitriles, epoxides, boron compounds, and phosphorus compounds. References detailing such treatment are listed in U.S. Pat. No. 4,654,403.

Yet other additives include corrosion inhibitors, extreme pressure agents, and anti-wear agents (including dithiophosphoric esters); chlorinated aliphatic hydrocarbons; boron-containing compounds including borate esters (which may be present at amounts to provide, e.g., up to 800 ppm boron); and molybdenum compounds. Friction modifiers can also be present, including such materials as molybdenum salts (molybdenum dialkylthiocarbamates) and fatty compounds such as glycerol monooleate or fatty amines (e.g., ethyoxylated amines such as polyoxyethylene tallowalkylamines (Ethomeen™ T/12), although certain of the benefits of the invention are more clearly revealed in formulations which do not contain friction modifiers such as glycerol monooleate. Viscosity improvers, which may also be present, include polyisobutenes, polymethyacrylate acid esters, polyacrylate acid esters, diene polymers, polyalkyl styrenes, alkenyl aryl conjugated diene copolymers, polyolefins and multi-functional viscosity improvers (the above-mentioned dispersant viscosity modifiers). Pour point depressants, another additive, usually comprise substances such as polymethacrylates, styrene-based polymers, crosslinked alkyl phenols, or alkyl naphthalenes. See for example, page 8 of "Lubricant Additives" by C. V. Smalheer and R. Kennedy Smith (Lesius-Hiles Company Publishers, Cleveland, Ohio., 1967). Anti-foam agents can be used to reduce or prevent the formation of stable foam include silicones or organic polymers. Examples of these and additional anti-foam compositions are described in "Foam Control Agents", by Henry T. Kerner (Noyes Data Corporation, 1976), pages 125-162. Antioxidants are also typically included, typically of the aromatic amine or hindered phenol type, including ester-containing hindered phenols as described in PCT published application WO 01/74978. In one embodiment the amount an a hindered phenol antioxidant can be 1.0 to 5.0 percent and the amount of an aryl amine antioxidant can be 0.1 to 4.0%; the antioxidants can be used separately or in combination. These and other additives which may be used in combination with the present invention are described in greater detail in U.S. Pat. No. 4,582,618 (column 14, line 52 through column 17, line 16, inclusive).

It is known that some of the materials described above may interact in the final formulation, so that the components of the final formulation may be different from those that are initially added. For instance, metal ions (of, e.g., a detergent) can migrate to other acidic sites of other molecules. The products formed thereby, including the products formed upon employing the composition of the present invention in its intended use, may not be susceptible of easy description. Nevertheless, all such modifications and reaction products are included within the scope of the present invention; the present invention encompasses the composition prepared by admixing the components described above.

EXAMPLES

Syntheses of chlorine-route hydrocarbyl-substituted Succinic anhydride Preparative Example A Conventional polyisobutene, $\overline{M}_n$ 2000, prepared using $AlCl_3$ catalyst, 3000 g, and maleic anhydride, 101 g, are added to a 4-neck, 5-L round bottom flask equipped with an overhead stirrer, a thermowell with thermocouple, subsurface gas inlet tube, and appropriate condensers and traps. The mixture is heated, with stirring, to 146° C. Chlorine gas (39.5 g) is added over 5 hours while increasing the temperature to 165° C. The mixture is then heated to 182° C. over 2 hours and maintained at 182° C. for 1 hour. Additional chlorine gas (45.7 g) is added over 5 hours, while increasing the temperature to 193° C. The mixture is further heated to 196° C. and maintained for 5 hours and thereafter at 215° C. for 25 hours with a subsurface nitrogen purge.

Syntheses of non-chlorine hydrocarbyl-substituted Succinic anhydrides Preparative Example B To a 4-neck 1 L flask equipped substantially as in Preparative Example A is charged 500 g of 1000 $\overline{M}_n$ high vinylidene polyisobutylene and 110 g maleic anhydride. The mixture is heated, with stirring to 203° C. over 3 hours and maintained at this temperature for 24 hours. The mixture is then heated to 210° C. under vacuum (less than 0.7 kPa [5 mm Hg]) for 1 hour to remove volatiles. The product is diluted with oil and filtered, to provide a product containing 40 weight % oil.

Preparative Example C

Preparative Example B is substantially repeated except that 500 g of 2000 $\overline{M}_n$ high vinylidene polyisobutylene and 68 g of maleic anhydride are employed. The product contains 30% oil.

Synthesis of Dispersants Preparative Example D

To a 4-neck, 1 L round bottom flask equipped with overhead stirrer, thermowell with thermocouple, Dean-Stark trap with condenser, and an equal-pressure addition funnel with subsurface inlet, are charged 300 g of a product prepared as in Example A and 253 g mineral oil. The mixture is heated, with stirring, to 110° C. and nitrogen flow is begun at 2.8 L/h (0.1 $ft^3$/hr). Polyethyleneamine bottoms (available form Dow as HPA-X™), 14 g, are added to the reaction mixture over 0.5 hour and the mixture is maintained at 110° C. for 0.5 hour after addition is complete. The mixture is heated to 155° C. and held for 5 hours with nitrogen flow. Filter aid is added to the mixture, which is filtered to yield the dispersant product in oil.

Preparative Example E

A similar dispersant is prepared from the material of Preparative Example B.

Preparative Example F

A similar dispersant is prepared from the material of Preparative Example C.

Preparative Example G

To a 2 L flask equipped as in Preparative Example D is added 350 g of a product prepared as in Preparative Example A and 250 g of a product prepared as in Preparative Example B, along with 327 g mineral oil. The mixture is heated, with stirring, to 110° C. and nitrogen flow is begun at 2.8 L/h (0.1 $ft^3$/hr). Polyethyleneamine bottoms, 28 g, are added to the mixture of 0.5 hours and the mixture is maintained at 110° C. for 0.5 hour after addition is complete. The mixture is heated to 155° C. and held for 5 hours with nitrogen flow. Filter aid is added to the mixture, which is filtered to yield the dispersant product in oil.

Examples 1-12

Dispersants are prepared from mixtures of succinic anhydrides as generally reported in the Preparative Examples above, with varying percentages of the thermal product and the chlorine-process product, as indicated in the following Table 2. Each dispersant composition is in the form of a concentrate containing 45% diluent oil, 55% active chemical. The viscosity of the dispersant composition is reported, as well as the percent increase in viscosity for certain additive concentrate formulations containing the dispersant, after storage for 8 weeks at 65° C.:

TABLE 2

| Ex. | | Wt %. thermal succinic anhydride used | Properties of Dispersant TBN | ppm Cl | Viscosity, 100° C., $mm^2/s$ | Visc increase of additive conc., % a | b | c |
|---|---|---|---|---|---|---|---|---|
| 1* | e | 0 | 15 | 596 | 465 | — | — | 3.0 |
| 2 | e | 20 | 17.4 | 468 | 386 | — | — | 1.0 |
| 3 | e | 30 | 18.5 | 408 | 342 | — | — | 0.7 |
| 4 | e | 40 | 19.7 | 352 | 333 | — | — | 0.7 |
| 5* | f | 0 | 11.5 | 593 | 500 | 14.7 | 5.0 | — |
| 6 | f | 20 | 15.16 | 476 | 418 | 5.2 | 1.0 | — |
| 7 | f | 30 | 16.4 | 411 | 383 | 4.0 | 1.2 | — |
| 8 | f | 40 | 17.9 | 347 | 356 | 3.2 | −0.1 | — |
| 9* | g | 0 | 15 | 596 | 465 | 7.9 | 0.5 | 3.7 |
| 10 | g | 20 | 13.2 | 463 | 406 | 6.9 | 1.4 | 5.2 |
| 11 | g | 30 | 14.3 | 402 | 380 | 3.8 | 0.8 | 4.1 |
| 12 | g | 40 | 13.7 | 336 | 358 | 3.4 | 1.0 | 3.8 |

*a comparative example a - additive concentrate which contains about 50% by weight of the indicated dispersant (including diluent oil) and smaller, conventional amounts of zinc dialkyldithiophosphate, antioxidants, calcium sulfonate detergents, and anti-foam agent.

b - a similar formulation to "a," wherein the additive package contains about 49% of the indicated dispersant and also about 1.9% glycerol monooleate, an additive known to ameliorate viscosity increase.

c - a similar formulation to "a," wherein the additive package contains about 47% of the indicated dispersant, as well as about 3.7% glycerol monooleate and 1.9% sunflower oil.

e - dispersant prepared from 2000 $\overline{M}$n polyisobutene-succinic anhydride, chlorine-process, and indicated amount of 1000 $\overline{M}$n polyisobutene-succinic anhydride, thermal process, reacted with polyethylene polyamine bottoms, CO:N ratio = 1:0.9.

f - dispersant prepared as for "e," except CO:N ratio = 6:5.

g - dispersant prepared as in "e," except the thermal-process material is prepared using 2300 $\overline{M}$n polyisobutene. CO:N ratio = 1:0.9.

The results in Table 2 show that compositions containing 20-40% of the thermal-process succinic anhydride material exhibit reduced amounts of chlorine and also, in the case of the thermal product prepared from the 1000 $\overline{M}_n$ polyisobutene, improved resistance to viscosity increase upon ageing. The improvements in viscosity behavior are more pronounced in formulations containing little or no glycerol monooleate.

Examples 13-20

Additional dispersants are prepared from mixtures as of the materials of "g" in Table 2, but with CO:N ratio as shown in the footnotes Table 3, and are tested in additive concentrate d. The results of viscosity increase after 8 weeks at 65° C. are reported in Table 3:

TABLE 3

| Ex. | | Wt %. thermal succinic anhydride used | Properties of Dispersant TBN | ppm Cl | Viscosity, 100° C., $mm^2/s$ | Visc, increase, %, of additive concentrate . . . d |
|---|---|---|---|---|---|---|
| 13* | h | 0 | 14.2 | 2830 | 474 | 13.6 |
| 14 | h | 25 | 13.4 | 1956 | 242 | 9.4 |
| 15 | h | 50 | 11.5 | 1339 | 173 | 6.8 |
| 16 | h | 75 | 10.6 | 680 | 136 | 4.3 |
| 17* | h | 100 | 8.4 | — | 117 | 5.4 |
| 18* | i | 0 | 23.2 | 2621 | 330 | 9.6 |

TABLE 3-continued

| Ex. | | Wt %. thermal succinic anhydride used | Properties of Dispersant TBN | ppm Cl | Viscosity, 100° C., $mm^2/s$ | Visc, increase, %, of additive concentrate . . . d |
|---|---|---|---|---|---|---|
| 19 | i | 50 | 17.9 | 1367 | 163 | 5.0 |
| 20* | i | 100 | 11.5 | — | 122 | 4.9 |

*a comparative example d - additive concentrate which contains about 46% by weight of the indicated dispersant (including diluent oil) and smaller, conventional amounts of zinc dialkyldithiophosphate, antioxidants, calcium sulfonate detergents, calcium phenate detergent, about 13% additional Cl-route dispersant, besides that indicated in the Table, amide friction modifier, and antifoam agent.

h - dispersant having CO:N = 6:5, 55% oil, 45% active chemical i - dispersant having CO:N = 1:1, 53% oil, 47% active chemical

Examples 21-30

Mixtures of dispersants are prepared by blending together individual dispersants along with conventional components to form a concentrate with the same additional additives as in composition "d" in Table 3. The results of viscosity increase after 8 weeks at 65° C. are presented in Table 4

TABLE 4

| Ex. | | Wt %. thermal succinic anhydride dispersant | Viscosity increase, % |
|---|---|---|---|
| 21* | j | 0 | 21.7 |
| 22 | j | 30 | 8.9 |
| 23 | j | 50 | 7.6 |
| 24 | j | 70 | 5.6 |
| 25 | j | 100 | 5.4 |
| 26* | k | 0 | 9.6 |
| 27 | k | 30 | 6.5 |
| 28 | k | 50 | 4.4 |
| 29 | k | 70 | 4.2 |
| 30 | k | 100 | 4.9 |

*a comparative example j - concentrate contains a mixture of C1-process dispersant which is prepared from polyisobutene succinic anhydride, and thermal process dispersant which is prepared from polyisobutene succinic anhydride, each dispersant having a CO:N ratio of 6:5 and containing 45% chemical, 55% oil.

k - concentrate containing a mixture of dispersants as described in j except that each dispersant has a CO:N ratio of 1:1 and contains 47% chemical, 53% oil.

Examples 31-37

The following are examples which exhibit progressively reduced Cl levels at increasing percentage of thermal process dispersant, and good viscosity performance at 100° C. These materials, as with certain other formulations, exhibit little or no differences in viscosity increase after storage over the range examined. This is believed to be because the particular formulations (perhaps because they have a relatively low CO:N ratio, e.g., less than 0.9:1) do not exhibit much "viscosity creep" even in the absence of the present invention:

TABLE 5

| Ex. | | Wt %. thermal succinic anhydride used | Properties of Dispersant TBN | ppm Cl | Viscosity, 100° C., $mm^2/s$ | Visc, increase, %, of additive concentrate . . . n |
|---|---|---|---|---|---|---|
| 31* | l | 0 | 24.4 | 1771 | 182 | 3.08 |
| 32 | l | 20 | 30.7 | 656 | 186 | 3.75 |
| 33 | l | 30 | 31.7 | 572 | 177 | 4.64 |
| 34 | l | 40 | 31.2 | 484 | 168 | 5.77 |
| 35 | m | 20 | 21.7 | 668 | 189 | 2.43 |
| 36 | m | 30 | 20.7 | 591 | 186 | 2.63 |
| 37 | m | 40 | 20.1 | 497 | 181 | 2.34 |

*a comparative example, prepared from a different batch of Cl-based material than examples 32–34.

l - dispersant having CO:N = 0.77:1, 50% oil, 50% active chemical, prepared from mixture of a succinic anhydride made as in Preparative Example A (without the final heating at 215° C.) and the material of Preparative Example B, in the amounts shown.

m - dispersant as in "l" except the material of Preparative Example B is replaced by that of Preparative Example C.

n - additive concentrate which contains about 55% by weight of the indicated dispersant (including diluent oil) and smaller, conventional amounts of zinc dialkyldithiophosphate, thiadiazole corrosion inhibitor, antioxidant(s), calcium sulfonate detergent(s), calcium phenate detergent(s), and antifoam agent.

Examples 38-39

Diesel Lubricant Formulations

Two formulations are prepared which are characteristic of diesel engine lubricant formulations, having reduced sulfur and phosphorus content, and containing the mixed dispersant of the present invention. A reference formulation is also prepared characteristic of a conventional diesel engine formulation, as shown.

Example 38

A mineral base oil (mixed 200N and 100N) containing conventional viscosity index modifiers;

- 5.0% chlorine-process succinimide dispersant, from 2000 $\overline{M}_n$ polyisobutylene succinic anhydride+polyethylene polyamines, CO:N ratio 1: (1.3-1.6), including 50% diluent oil
- 3.85% thermal-process succinimide dispersant, from 1550 $\overline{M}_n$ polyisobutylene succinic anhydride+an ethylenepolyamine, CO:N ratio 1: (0.7-0.8), including 30% diluent oil
- 0.5% zinc dialkyldithiophosphate(s)
- 1.3% alkyl borate(s)
- 3.65% overbased Ca and Mg detergent(s), including a Mg saligenin detergent, including conventional diluent oil
- 5.5% antioxidant(s)
- 0.6% antiwear additive
- 100 ppm commercial silicone defoamer

Example 39 (Reference)

The formulation of Example 38 is repeated, except that 10% of the chlorine-process succinimide dispersant is used, and none of the thermal-process succinimide dispersant.

The formulations of Example 38 and Reference Example 39 are subjected to a series of tests, including the Volkswagen PV 3344 seal tests for tensile strength and elongation (involving exposing specimens of Parker-Prädifa™ SRE AK6 fluorocarbon elastomer to test formulation at 150° C. for 282 hours total prior to testing), the Mercedes Benz fluoroelastomer seal tests for tensile strength and elongation (involving heating the specimens in the test formulation at 150° C. for 168 hours, reporting % change from the original values), viscosity increase test (by blowing air through a sample of oil for 24 hours at 200° C. and measuring change of viscosity of the sample at 40° C.), HFRR wear scar test (in which a sample of oil, treated with 1% cumene hydroperoxide, is used to lubricate a non-rotating steel ball loaded at 500 g at 105° C., rubbed against a disk with a 1 mm stroke at 20 Hz for 75 minutes, the resulting wear scar diameter reported in μm, and the HTCBT corrosion test (ATDM D-6594). The results are presented in Table 6:

TABLE 6

| | PV3344 | | MB fluoroelast'r | | Viscosity | | |
|---|---|---|---|---|---|---|---|
| Ex.\test | Tensile ($Nmm^{-2}$) | Elong. (%) | Tensile (%) | Elong. (%) | Increase (%) | HFRR wear scar (μm) | HTCBT ppm Cu |
| 38 | 9.5 | 231 | −30 | −25 | 30 | 236 | 5 |
| 39 (ref) | 6.5 | 183 | −44 | −38 | 32 | 248 | 39 |

The formulations of Example 38 and Reference Example 39 are further subjected to a High Temperature Cameron Plint Test. This wear test employs a Plint™ TE-77 high frequency friction machine with 100 N load and 20 Hz frequency over a 2.5 mm stroke length with a ball-on-flat contact geometry. Test samples of oil are pre-treated with cumene hydroperoxide. The test is conducted at 150° C. for 75 minutes, and the results are reported as the wear scar on the ball.

TABLE 7

| Ex.\test | Cameron Plint wear scar |
|---|---|
| 38 | 339 μm |
| 39 (ref) | 378 μm |

The results show that the formulation containing the dispersants of the present invention exhibits equivalent or superior performance in terms of seal performance, viscosity increase, antiwear performance, and corrosion compared with a conventional baseline formulation, even though the formulation of Example 38 contains a reduced amount of zinc dialkyldithiophosphate.

Each of the documents referred to above is incorporated herein by reference. Except in the Examples, or where otherwise explicitly indicated, all numerical quantities in this description specifying amounts of materials, reaction conditions, molecular weights, number of carbon atoms, and the like, are to be understood as modified by the word "about." Unless otherwise indicated, each chemical or composition referred to herein should be interpreted as being a commercial grade material which may contain the isomers, by-products, derivatives, and other such materials which are normally understood to be present in the commercial grade. However, the amount of each chemical component is presented exclusive of any solvent or diluent oil, which may be customarily present in the commercial material, unless otherwise indicated. It is to be understood that the upper and lower amount, range, and ratio limits set forth herein may be independently combined. Similarly, the ranges and amounts for each element of the invention can be used together with ranges or amounts for any of the other elements. As used herein, the expression "consisting essentially of" permits the inclusion of substances that do not materially affect the basic and novel characteristics of the composition under consideration.

What is claimed is:

1. A composition comprising an oil of lubricating viscosity and a dispersant composition comprising the product of (1) at least one alkylene polyamine having at least one N-H group with (2) a polyisobutene-substituted succinic anhydride component or the reactive equivalent thereof, wherein the polyisobutene-substituted succinic anhydride component comprises:

(a) about 10 to 80 weight percent of a component wherein at least one succinic anhydride moiety is attached to the polyisobutene substituent through a cyclic linkage; and (b) 20 to about 90 weight percent of a component wherein at least one succinic anhydride moiety is attached to the polyisobutene substituent through a non-cyclic linkage;

wherein at least one alkylene polyamine is reacted separately with the polyisobutene-substituted anhydrides of (a) and of (b) and the reaction products are mixed together in amounts corresponding to (a) and (b);

wherein the polyisobutene substituents of components (a) and (b) independently have a molecular weight, $\overline{M}_n$, of about 800 to about 2500;

wherein the dispersant composition has a CO:N ratio of at least 0.9:1;

said composition being free of glycerol monooleate; wherein:

the polyisobutene-substituted succinic anhydride component (a) is prepared by reacting a polyisobutylene, less than about 20 percent of the chains thereof containing a terminal vinylidene end group, with maleic anhydride in the presence of chlorine;

and the polyisobutene-substituted succinic anhydride component (b) is prepared by reacting a polyisobutylene, at least about 70 percent of the chains thereof containing a terminal vinylidene end group, with maleic anhydride in the substantial absence of chlorine.

2. The composition of claim 1 wherein the succinic anhydride component comprises about 30 to 80 weight percent of (a) and 20 to about 70 weight percent (b).

3. The composition of claim 1 wherein the succinic anhydride component comprises about 50 to 80 weight percent of (a) and 20 to about 50 weight percent (b).

4. The composition of claim 1 wherein the alkylene polyamine comprises a poly(ethyleneamine).

5. The composition of claim 4 wherein the alkylene polyamine is poly(ethyleneamine) bottoms.

6. The composition of claim 1 wherein the polyisobutene-substituted succinic anhydride of (a) contains on average about 1.3 to about 1.8 succinic anhydride moieties per hydrocarbyl group.

7. The composition of claim 1 wherein the oil of lubricating viscosity is present in an amount to provide a fully formulated lubricant.

8. The composition of claim 7 wherein the amount of the dispersant of (a) is about 1 to about 6 percent by weight and the amount of the dispersant of (b) is about 1 to about 9 percent by weight.

9. The composition of claim 1 further comprising about 1 to about 5 percent by weight of a hindered phenol antioxidant or about 0.1 to about 4 percent by weight of an aryl amine antioxidant or such amounts of both antioxidants.

10. The composition of claim 1 wherein the oil is present in a concentrate-forming amount.

11. The composition of claim 10 wherein the amount of the dispersant composition is about 30 to about 80 percent by weight.

12. The composition of claim 10 further comprising at least one metal-containing detergent or at least one metal-containing compound of sulfur and of phosphorus.

13. The composition of claim 10 wherein the amount of oil is about 30 percent to about 80 percent by weight.

14. The composition of claim 1 further comprising at least one metal-containing detergent or at least one metal-containing compound of sulfur and of phosphorus.

15. The composition of claim 14 wherein the metal-containing detergent comprises an overbased calcium salixarate or an overbased magnesium saligenin or an overbased calcium sulfonate.

16. A method for lubricating an internal combustion engine, comprising supplying thereto the composition of claim 1.

17. The composition of claim 1 wherein the CO:N ratio of the dispersant of (b) is about 1:1 to about 1.43:1.

18. A composition comprising an oil of lubricating viscosity and a dispersant composition comprising the product of (1) at least one alkylene polyamine having at least one N-H group with (2) a polyisobutene-substituted succinic anhydride or the reactive equivalent thereof, wherein the polyisobutene-substituted succinic anhydride component comprises:

(a) about 10 to about 95 weight percent of a component prepared by reacting a polyisobutylene, less than about 20 percent of the chains thereof containing a terminal vinylidene end group, with maleic anhydride in the presence of chlorine; and (b) about 5 to about 90 weight percent of a component prepared by reacting a polyisobutylene, at least about 70 percent of the chains thereof containing a terminal vinylidene end group, with maleic anhydride in the substantial absence of chlorine;

wherein at least one alkylene polyamine is reacted separately with the polyisobutene-substituted anhydrides of (a) and of (b) and the reaction products are mixed together in amounts corresponding to (a) and (b);

wherein the polyisobutene substituents of components (a) and (b) independently have a molecular weight, $M_n$, of about 800 to about 2500;

wherein the dispersant composition has a CO:N ratio of at least 0.9:1;

said dispersant composition being free of glycerol monooleate.

19. A composition comprising an oil of lubricating viscosity and a mixture of dispersants, comprising a mixture of:

(a) about 10 to about 95 weight percent of a dispersant prepared by reacting a polyisobutylene, less than about 20 percent of the chains thereof containing a terminal vinylidene end group, with maleic anhydride in the presence of chlorine, and reacting the intermediate formed thereby with at least one alkylene polyamine having at least one N-H group; and (b) about 5 to about 90 weight percent of a dispersant prepared by reacting a polyisobutylene, at least about 70 percent of the chains thereof containing a terminal vinylidene end group, with maleic anhydride in the substantial absence of chlorine, and reacting the intermediate formed thereby with at least one alkylene polyamine having at least one N-H group;

wherein the polyisobutene substituents of components (a) and (b) independently have a molecular weight, $M_n$, of about 800 to about 2500;

wherein the mixture of dispersants has a CO:N ratio of at least 0.9:1;

said composition being free of glycerol monooleate.

20. The composition of claim 19 wherein the mixture of dispersants comprises about 50 to 80 weight percent of (a) and 20 to about 50 weight percent (b).

21. The composition of claim 19 wherein the alkylene polyamine in component (a) and in component (b) comprises a poly(ethyleneamine).

22. The composition of claim 19 wherein the oil of lubricating viscosity is present in an amount to provide a fully formulated lubricant.

23. The composition of claim 22 wherein the amount of the dispersant of (a) is about 1 to about 6 percent by weight and the amount of the dispersant of (b) is about 1 to about 9 percent by weight.

24. The composition of claim 19 further comprising about 1 to about 5 percent by weight of a hindered phenol antioxidant or about 0.1 to about 4 percent by weight of an aryl amine antioxidant or such amounts of both antioxidants.

25. The composition of claim 19 wherein the oil is present in a concentrate-forming amount and the amount of the mixture of dispersants is about 30 to about 80 percent by weight.

26. The composition of claim 19 further comprising at least one metal-containing detergent or at least one metal-containing compound of sulfur and of phosphorus.

27. A method for lubricating an internal combustion engine, comprising supplying thereto the composition of claim 19.

28. The composition of claim 19 wherein the CO:N ratio of the dispersant of(b) is about 1:1 to about 1.43:1.

* * * * *